US006152397A

United States Patent [19]

Purcell

[11] Patent Number: 6,152,397

[45] Date of Patent: Nov. 28, 2000

[54] SPACING MEMBER FOR A SHEET MATERIAL DISPENSER

[75] Inventor: Ricky Wayne Purcell, Alpharetta, Ga.

[73] Assignee: Kimberly-Clark Worldwide Inc., Neenah, Wis.

[21] Appl. No.: 09/183,787

[22] Filed: Oct. 30, 1998

[51] Int. Cl.[7] ..... B65H 19/00

[52] U.S. Cl. ..... 242/560.1; 242/563.2

[58] Field of Search ..... 242/560, 560.1, 242/564.4, 563, 563.2

[56] References Cited

U.S. PATENT DOCUMENTS

| | | | |
|---|---|---|---|
| 2,974,839 | 3/1961 | Batlas et al. | 242/564.4 X |
| 3,126,234 | 3/1964 | Batlas et al. | 312/39 |
| 3,288,387 | 11/1966 | Craven, Jr. . | |
| 3,628,743 | 12/1971 | Bastian | 242/560.1 |
| 3,917,191 | 11/1975 | Graham, Jr. et al. . | |
| 4,010,909 | 3/1977 | Bastian . | |
| 4,067,509 | 1/1978 | Graham, Jr. et al. . | |
| 4,106,684 | 8/1978 | Hartbauer et al. | 226/91 |
| 4,148,442 | 4/1979 | Baumann et al. . | |
| 4,165,138 | 8/1979 | Hedge et al. | 312/39 |
| 4,192,442 | 3/1980 | Bastian et al. . | |
| 4,317,547 | 3/1982 | Graham, Jr. et al. . | |
| 4,358,169 | 11/1982 | Filipowicz et al. | 312/39 |
| 4,378,912 | 4/1983 | Perrin et al. . | |
| 4,396,163 | 8/1983 | Graham, Jr. et al. | 242/560.1 |
| 4,403,748 | 9/1983 | Cornell | 242/560.1 |
| 4,666,099 | 5/1987 | Hoffman et al. . | |
| 4,756,485 | 7/1988 | Bastian et al. . | |
| 4,807,824 | 2/1989 | Gains et al. . | |
| 5,244,161 | 9/1993 | Wirtz-Odenthal . | |
| 5,294,192 | 3/1994 | Omdoll et al. | 312/34.22 |
| 5,302,167 | 4/1994 | Kley et al. | 242/560.1 X |
| 5,375,785 | 12/1994 | Boone et al. | 242/560.1 |
| 5,400,982 | 3/1995 | Collins | 242/560 |
| 5,526,973 | 6/1996 | Boone et al. | 225/34 |
| 5,604,992 | 2/1997 | Robinson | 242/560 X |

*Primary Examiner*—Donald P. Walsh
*Assistant Examiner*—Wiliam A. Rivera
*Attorney, Agent, or Firm*—Scott B. Garrison

[57] ABSTRACT

A spacer member for a sheet material dispenser. Desirably, the spacer member may be positioned between a first sheet material and a second sheet material for minimizing contact between the first and second sheet materials and preventing the inadvertent dispensing of the second sheet material.

9 Claims, 6 Drawing Sheets

SPACING MEMBER FOR A SHEET MATERIAL DISPENSER

FIELD OF THE INVENTION

This invention generally relates to the field of dispensers, and more specifically, to a member for a sheet material dispenser.

BACKGROUND

Dispensers may provide sheet material to users. Often, the sheet material is wound upon a roll and placed in the dispenser. Rotating the roll permits dispensing of the sheet material.

Generally, sheet material is dispensed until the roll is depleted. Some dispensers have a second roll of sheet material housed within the dispenser. This second roll begins dispensing once the first roll is depleted. This secondary roll reduces dispenser inoperability due to an exhausted sheet material supply.

Unfortunately, sometimes the second roll may dispense material prematurely. Often, the space within the dispenser is limited, therefore these rolls are placed in close proximity to each other. Sheet material from the first roll may inadvertently contact sheet material from the second roll. The sheet material from the second roll then attaches to the sheet material from the first roll by static or frictional forces. Operating the dispenser feeds sheet material from both rolls simultaneously, thereby wasting material. Fixing the situation may require extra maintenance by opening the dispenser and separating the sheets.

In addition, dispensers often provide a large volume of dispensing material. However, there are constraints on the space available for these units. Therefore, it is highly desirable to provide a dispenser to house the maximum amount of sheet material while minimizing the dispenser size.

Accordingly, a dispenser that prevents the simultaneous dispensing of sheet material from two distinct sources and minimizes dispenser volume will improve over conventional dispensers.

DEFINITIONS

As used herein, the term "comprises" refers to a part or parts of a whole, but does not exclude other parts. That is, the term "comprises" is open language that requires the presence of the recited element or structure or its equivalent, but does not exclude the presence of other elements or structures. The term "comprises" has the same meaning and is interchangeable with the terms "includes" and "has".

As used herein, the term "coupled" refers to two things joined or linked together either directly or indirectly.

As used herein, the term "nonwoven web" refers to a web that has a structure of individual fibers which are interlaid forming a matrix, but not in an identifiable repeating manner. Nonwoven webs have been, in the past, formed by a variety of processes known to those skilled in the art such as, for example, meltblowing, spunbonding, wet-forming and various bonded carded web processes.

As used herein, the term "spunbond web" refers to a web formed by extruding a molten thermoplastic material as filaments from a plurality of fine, usually circular, capillaries with the diameter of the extruded filaments then being rapidly reduced, for example, by fluid-drawing or other well known spunbonding mechanisms. The production of spunbond nonwoven webs is illustrated in patents such as Appel, et al., U.S. Pat. No. 4,340,563.

As used herein, the term "meltblown web" means a web having fibers formed by extruding a molten thermoplastic material through a plurality of fine, usually circular, die capillaries as molten fibers into a high-velocity gas (e.g. air) stream which attenuates the fibers of molten thermoplastic material to reduce their diameters. Thereafter, the meltblown fibers are carried by the high-velocity gas stream and are deposited on a collecting surface to form a web of randomly disbursed fibers. The meltblown process is well-known and is described in various patents and publications, including NRL Report 4364, "Manufacture of Super-Fine Organic Fibers" by V. A. Wendt, E. L. Boone, and C. D. Fluharty; NRL Report 5265, "An Improved Device for the Formation of Super-Fine Thermoplastic Fibers" by K. D. Lawrence, R. T. Lukas, and J. A. Young; and U.S. Pat. No. 3,849,241, issued Nov. 19, 1974, to Buntin, et al., which are hereby incorporated by reference.

As used herein, the term "cellulose" refers to a natural carbohydrate high polymer (polysaccharide) having the chemical formula $(C_5H_{10}O_5)_n$ and consisting of anhydroglucose units joined by an oxygen linkage to form long molecular chains that are essentially linear. Natural sources of cellulose include deciduous and coniferous trees, cotton, flax, esparto grass, milkweed, straw, jute, hemp, and bagasse.

As used herein, the term "pulp" refers to cellulose processed by such treatments as, for example, thermal, chemical and/or mechanical treatments.

As used herein, the term "sheet material" refers to a substantially planar structure. Examples of sheet material include any fabric, such as woven towels, nonwoven towels, or sanitary paper made from natural or artificial polymers, such polyethylene, polypropylene, cellulose, or mixtures thereof.

As used herein, the term "x-direction" refers to the width across the front of the dispenser. As an example, referring to FIG. 1, a roller 70 extends substantially parallel to the x-direction and attaches to the sides of a housing 12.

As used herein, the term "y-direction" refers to the depth of the dispenser. As an example, referring to FIG. 3, the top of a housing 12 extends substantially parallel to the y-direction.

As used herein, the term "z-direction" refers to the height of the dispenser. As an example, referring to FIG. 3, the back of a housing 12 extends substantially parallel to the z-direction.

SUMMARY OF THE INVENTION

The problems and needs described above are addressed by the present invention, which provides a spacer member for a sheet material dispenser. Desirably, the spacer member may be positioned between a first sheet material and a second sheet material for minimizing contact between the first and second sheet materials and preventing the inadvertent dispensing of the second sheet material. Furthermore, the spacer member may serve as a wedge to separate the first and second sheet materials should these sheet materials come into contact.

In addition, the spacer member may further include a first end, a second end, and an arcuate body member. The first and second ends may be formed integrally with the arcuate body member.

Furthermore, the first end may include a curved portion formed integrally with a first leg, which may extend in a z-direction from the curved portion. The second end may include a curved portion formed integrally with a second leg, which may extend in a z-direction. Both legs may be formed integrally with the arcuate body member, which may extend in an opposing z-direction in relation to the first and second legs and in a y-direction.

Another embodiment of the present invention is a sheet material dispenser, which may include a first roll support for holding a sheet material roll, a second roll support for holding a sheet material roll, a means for dispensing sheet material, and a spacer member. The means for dispensing sheet material dispenses sheet material from the first sheet material roll and then from the second sheet material roll when the first roll is depleted. The spacing member minimizes contact between sheet material from the first and second rolls. Alternatively, the sheet material dispenser may include other means for separating sheet material for minimizing contact between sheet material from the first and second rolls.

A further embodiment of the present invention is a sheet material dispenser, which may include a first roll support, a second roll support, and a sensing member. The first and second roll supports may hold a respective sheet material roll, which may be substantially aligned. The sensing member may determine the amount of sheet material left on the first sheet material roll and position sheet material from the second sheet material roll away from sheet material from the first sheet material roll during dispensing of the first sheet material roll. Furthermore, the sheet material dispenser may further include a spacer member coupled to the sensing member for minimizing contact between sheet material from the first and second rolls. In addition, the sheet material dispenser may further include a housing, first and second feed rollers, a sensing roller, and a dispensing lever. The first and second roll supports, the sensing member, and the first and second feed rollers may be coupled to the housing. The sheet material from the first sheet material roll may pass through the first and second feed rollers. The sensing roller may be coupled to the sensing member and may contact sheet material from a first sheet material roll and sheet material from a second sheet material roll. The dispensing lever may be in mechanical communication with the feed rollers for dispensing sheet material from the sheet material rolls. Upon depletion of the first sheet material roll, the sensing member may position sheet material from the second sheet material roll into the feed rollers for dispensing.

A still further embodiment is a method for dispensing sheet material. The method may include the steps of providing a first roll having sheet material, providing a second roll having sheet material, and providing a spacer member for minimizing contact between sheet material from the first and second rolls. Alternatively, other means for separating sheet material may be provided for minimizing contact between sheet material from the first and second rolls and preventing the premature feed of sheet material from the second roll.

DETAILED DESCRIPTION OF THE PREFERRED EMBODIMENT(S)

Figure 1:
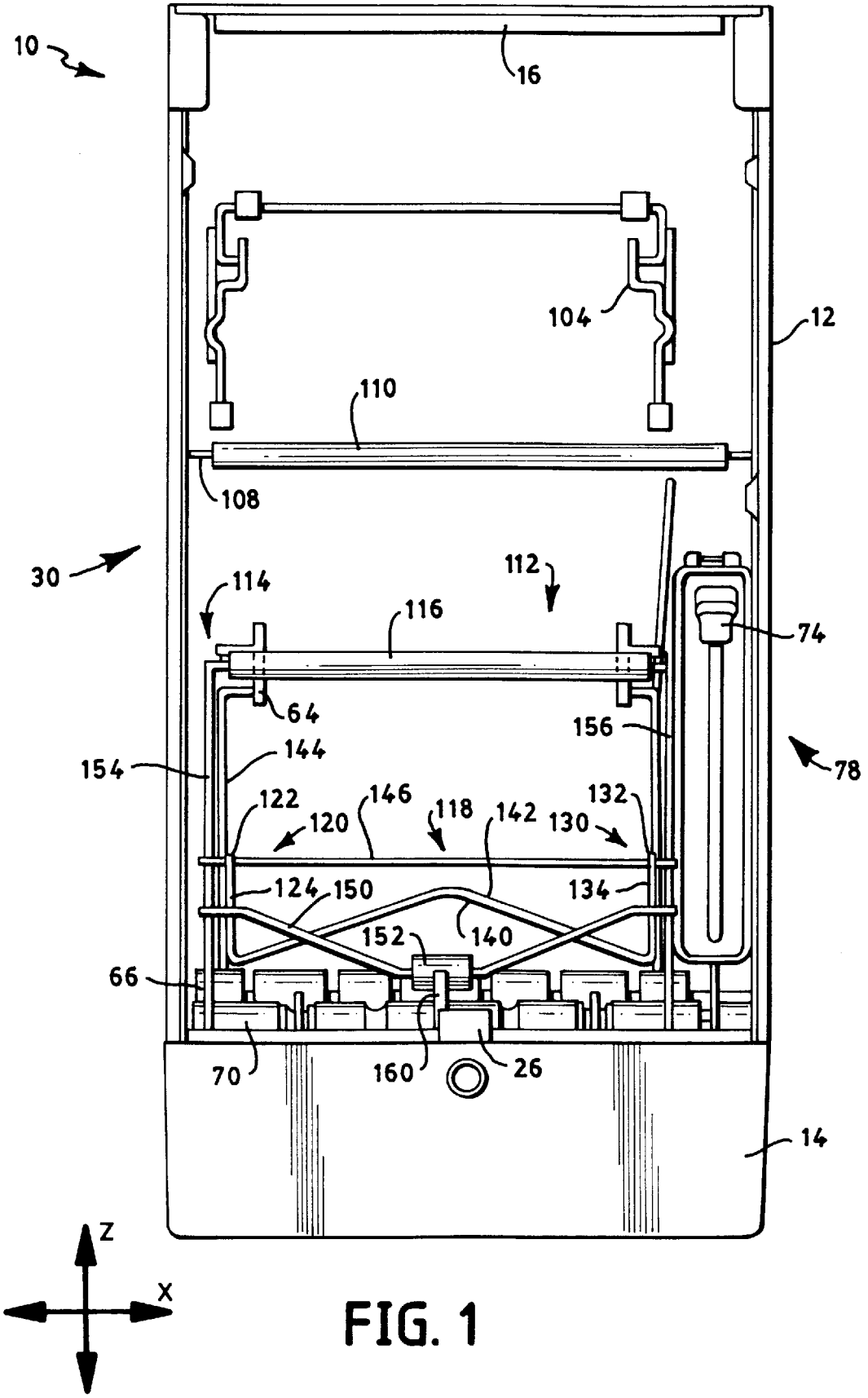
FIG. 1 is a front, elevational view of an exemplary dispenser of the present invention with an open door.
Figure 2:
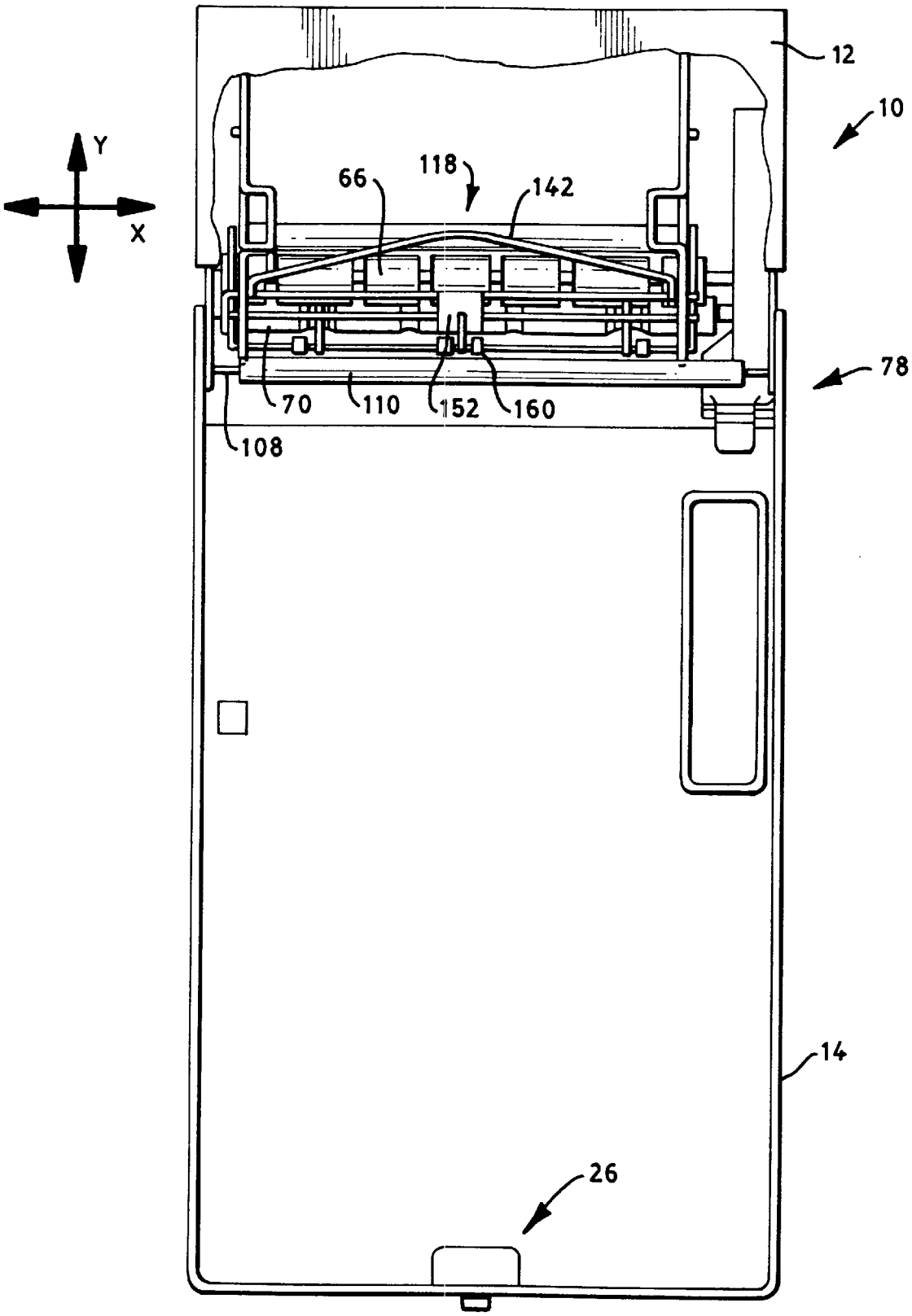
FIG. 2 is a top, plan cut-away view of the exemplary dispenser of the present invention with the door open.
Figure 3:
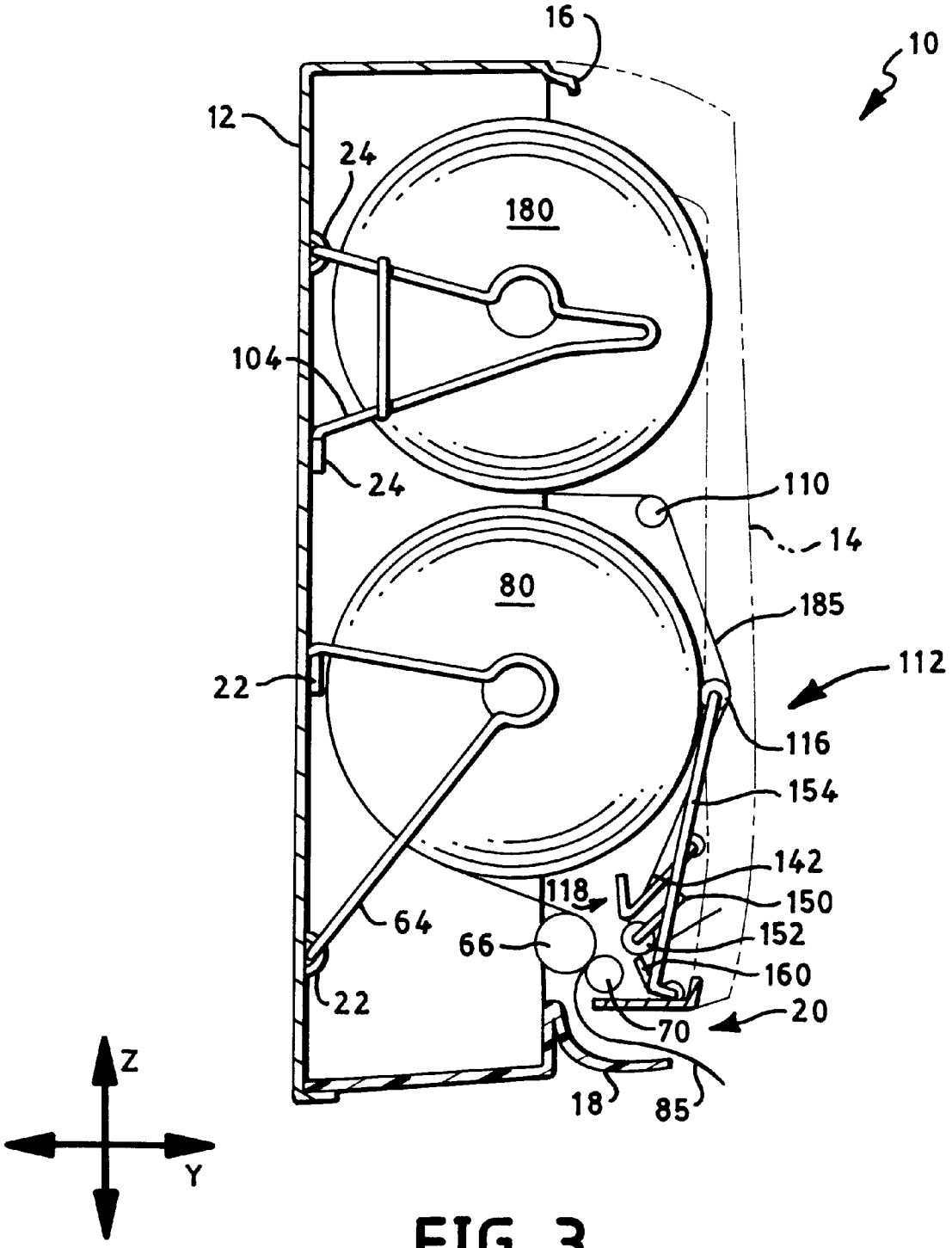
FIG. 3 is a side, elevational cross-sectional view of the exemplary dispenser housing two sheet material rolls.

Referring now to the drawings, like reference numerals designate corresponding structure throughout the views. Furthermore, x-, y-, and z-directions may be indicated on the FIGS. for better describing the present invention. Referring in particular to FIGS. 1–3, there is a sheet material dispenser 10 of the present invention. The sheet material dispenser 10 may include a housing 12, a door 14, and an interior 30. The housing 10 may further include a lip 16 and an arcuate section 18. Desirably, the door 14 is constructed from a semi-transparent plastic and the housing 12 is constructed from metal. The door 14 may be pivotally connected to the housing 12 using any suitable means, such as pins. The door 14 may be disengaged from the lip 16, using any suitable means such as a latch 26, and pivoted downward to open the dispenser 10 as depicted in FIGS. 1 and 2.

Referring to the dispenser interior 30, a first roll support 64, a second roll support 104, a first feed roller 66, a second feed roller 70, a means for dispensing 78, a spacer bar 108, and a sheet transfer mechanism 112 may be coupled to the housing 12. The supports 64 and 104, spacer bar 108, and sheet transfer mechanism 112 may be desirably constructed from metal such as steel, although components of these mechanisms may be constructed from other materials, such as plastics. The first roll support 64 may be mounted to the housing 12 using any suitable means, such as pins, bolts, or brackets. In one desirable embodiment, the roll support 64 mounts into brackets 22 formed integrally with the housing 12. The second roll support 104 may be connected to the housing 12 using any suitable means, such as pins, bolts, or brackets. In one desirable embodiment, the roll support 104 mounts into brackets 24 formed integrally with the housing 12.

A first sheet material roll 80 having sheet material 85 and a second sheet material roll 180 having sheet material 185 may be mounted onto respective supports 64 and 104. The sheet material 85 and 185 may be any fabric, such as nonwoven towels or sanitary paper made from natural or artificial polymers, such polyethylene, polypropylene, cellulose, or mixtures thereof. The housing 12 and door 14 may form an opening 20 for dispensing sheet material 85 and 185.

The first feed roller 66 and the second feed roller 70 may be mounted to the housing 12 using any suitable means, such as pins or brackets. Desirably, the means for dispensing 78 is a dispensing lever 74 constructed from metal and plastic and mounted to the housing 12 using any suitable means such as screws. Desirably, the dispensing lever 74 is in mechanical communication with the feed rollers 66 and 70. This communication allows the dispensing of sheet material by activating rollers 66 and 70, as exemplified by U.S. Pat. No. 4,192,442 to Bastian et al., which is hereby incorporated by reference. Desirably, one of the feed rollers 66 and 70 has a surface with a greater coefficient of friction than the other, as described by U.S. Pat. No. 3,628,743 to Media et al., which is hereby incorporated by reference. This friction differential may be created by constructing the roller 66 from rubber and the roller 70 from wood. Although the dispensing lever 74 has been described, other means for dispensing 78 may also be used, such as a rotatable handle coupled to the rollers 66 and 70.

The spacer bar 108 may be coupled to the housing 12 using any suitable means, such as brackets or pins, and may further include a substantially cylindrical, rotatable sleeve 110 made, desirably, from plastic.

Figure 6:
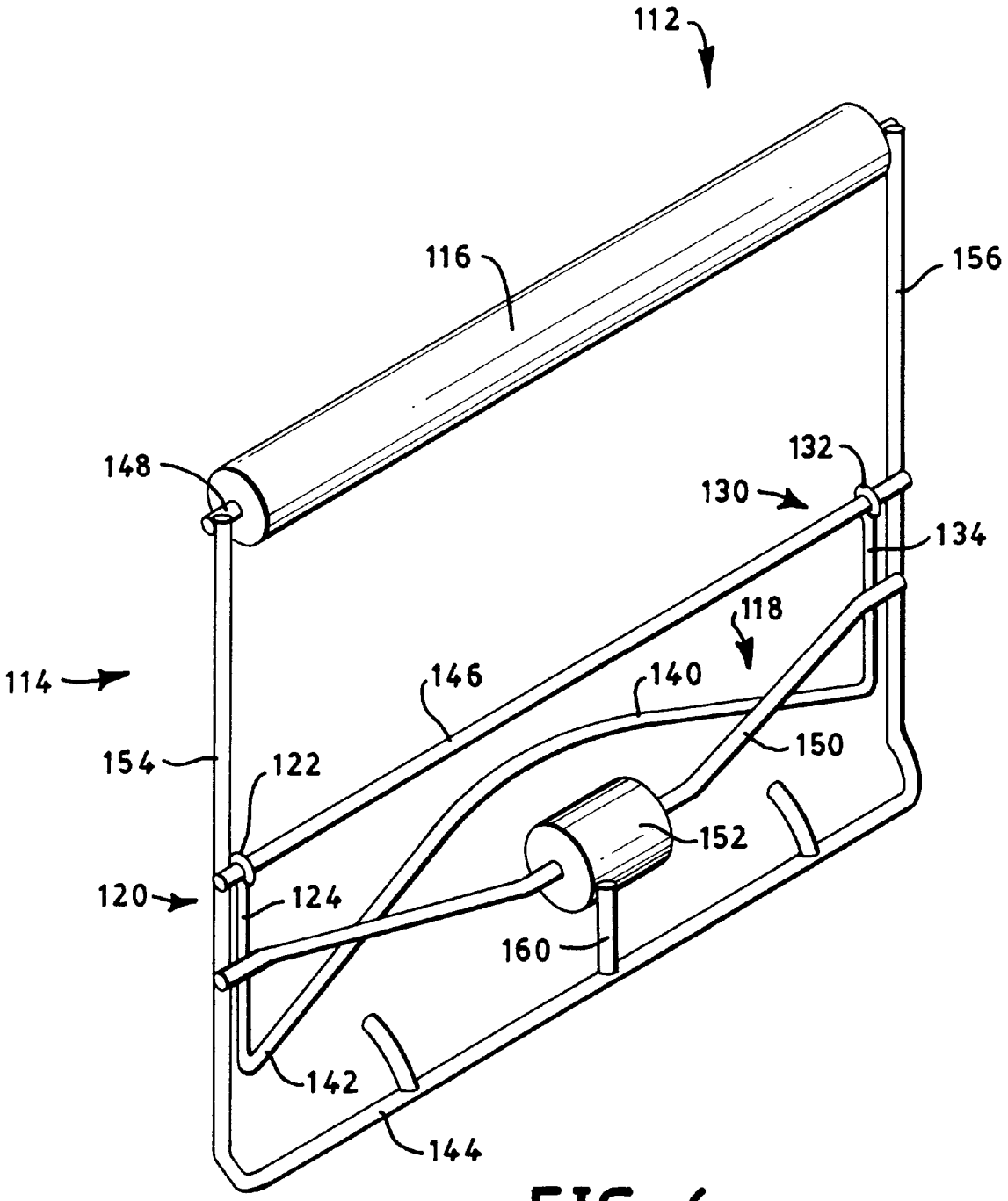
FIG. 6 is a perspective view of an exemplary spacing member and transfer arm coupled to a sensing member.

Referring to FIG. 6, the sheet transfer mechanism 112 may further include a sensing member 114, a rotatable sensing roller 116, a means for separating sheet material 118, and a transfer arm 150. Desirably, the sensing roller 116 is constructed from plastic.

The sensing member 114 may be pivotally coupled to the housing 12 using any suitable means, such as pins or brackets. The substantially rectangular-shaped sensing member 114 may further include a substantially U-shaped body 144, a substantially cylindrical, elongated support 146, a substantially elongated sensor support 148, and a prong 160.

The supports 146 and 148 may be attached to legs 154 and 156 of the substantially U-shaped body 144 using any suitable means, such as welding. The substantially cylindrical, rotatable sensing roller 116 may be coupled to the substantially cylindrical support 148. Desirably, the roller 116 is constructed from plastic. The transfer arm 150 may be coupled to the sensing member 114 using any suitable means, such as brackets or welding. In turn, a substantially cylindrical, rotatable roller 152, desirably constructed from plastic, may be coupled to the transfer arm 150. The prong 160 may be coupled to the body 144 using any suitable means such as welding.

The means for separating material sheets 118 may include mechanical devices, such as a spacer member 142, or may include using forces such as air pressure, or like electrostatic or electromagnetic charges to maintain the separation of sheet materials 85 and 185. The spacer member 142 may take the form of a linear bar, or at least one clip or pin for maintaining the separation of sheet materials 85 and 185.

One desirable spacer member 142 may be a curved bar of three dimensional geometry, which may include an arcuate body member 140 formed integrally with a first end 120 and a second end 130. The first end 120 may include a first curved portion 122 formed integrally with a first leg 124 and the second end 130 may include a second curved portion 132 formed integrally with a second leg 134. The curved portions 122 and 132 are pivotally coupled to the support 146 of the sensing member 114 by encircling its periphery.

The spacer member 142 maintains separation between sheet materials 85 and 185 by extending in the z-direction, as depicted in FIG. 1. This extension also provides some support for the sheet material 185 to prevent its sagging prior to dispensing. The arcuate body member 140 extends in an opposing z-direction from that of the legs 124 and 134. In addition, the arcuate body member 140 extends from the legs 124 and 134 in a y-direction, as depicted in FIGS. 2 and 3. This y-direction extension helps to physically separate the sheet materials 85 and 185, thereby preventing their inadvertent engagement. An engagement of the sheet materials 85 and 185 may result in the attachment of the sheet material 185 to the sheet 85. This attachment, in turn, would draw the sheet material 185 into the feed rollers 66 and 70 during dispensing of the sheet material 85, and thus result, in the inadvertent dispensing of the sheet material 185.

To begin operation of the dispenser 10, the door 14 is opened and the first sheet material roll 80 is mounted on the first roll support 64 and the second sheet material roll 180 is mounted on the second roll support 104. The sheet material 85 from the roll 80 is fed through the feed rollers 66 and 70 to exit the opening 20. The sheet material 185 is led over the roller 110 and downward over the sensing roller 116. Afterwards, it is let downward and wrapped upward around the transfer roller 152. The sheet material 185 is then impaled upon the prong 160. The sensing roller 116 is positioned in contact with the periphery of the first sheet material roll 80.

The arrangement of the various components with the dispenser 10 results in a more compact design than other dual roll sheet material dispensers. The present invention permits the dispensing of two full dispenser rolls while minimizing the equipment, and thus space, required for switching dispensing from one roll to the other. This is exemplified by the sensing roller 116 not only serving to maintain contact with the roll 80, but also being in contact with the sheet material 185 for positioning the sheet material 185 away from the roll 80.

Figure 4:
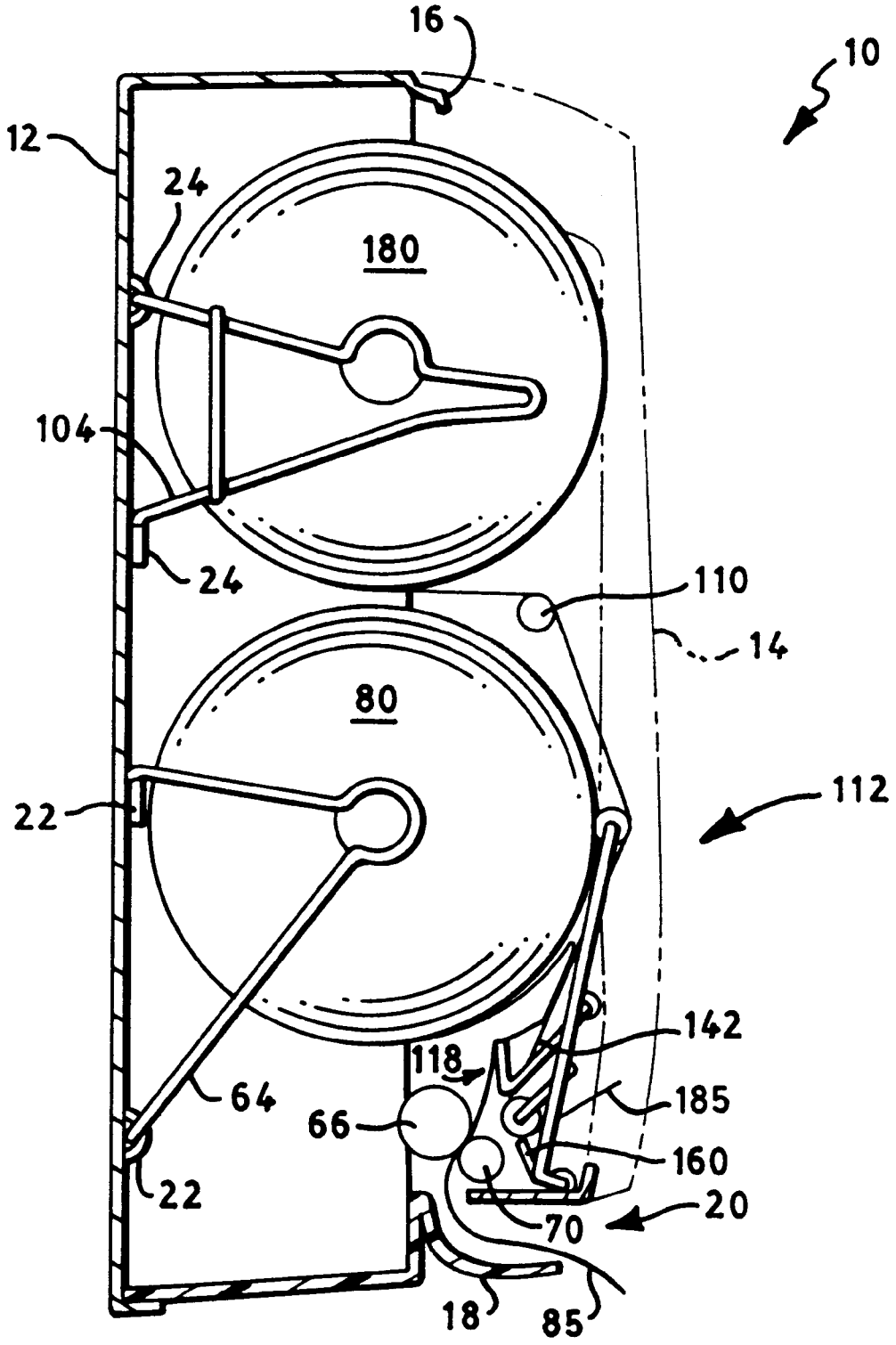
FIG. 4 is another side, elevational cross-sectional view of the exemplary dispenser housing two sheet material rolls.

Operating the lever 74 feeds the sheet material 85 from the first sheet material roll 80. The spacer member aids in maintaining the separation between sheet materials 85 and 185. However, if excessive sheet material 85 is fed from the roll 80, it may back-up and come into contact with the sheet material 185 as depicted in FIG. 4. However, the spacing member 142 may serve as a wedge to separate these materials 85 and 185 upon continued dispensing of the sheet material 85. Thus, the dispenser will return to normal operation as depicted in FIG. 3.

Figure 5:
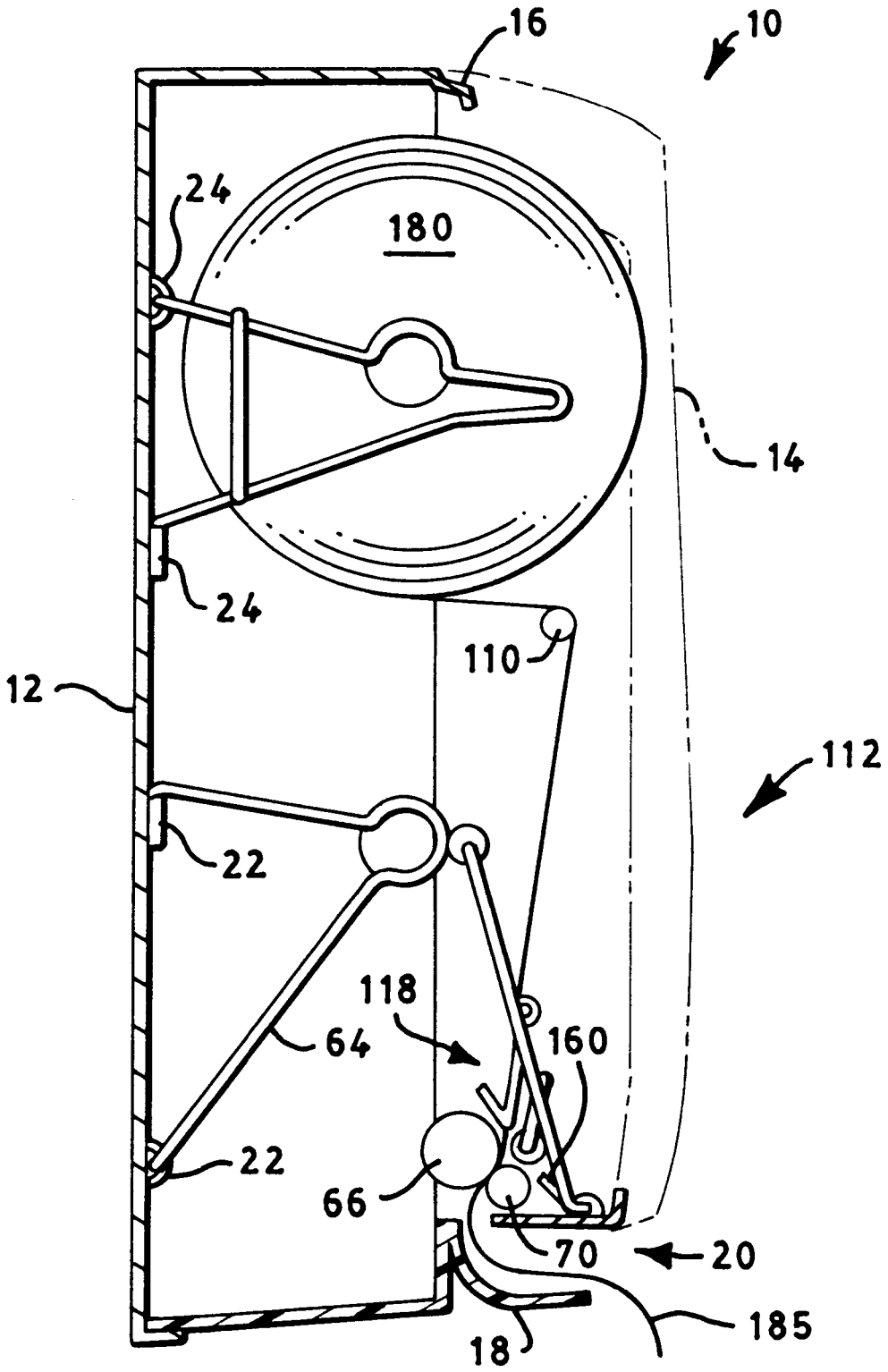
FIG. 5 is a further elevational cross-sectional view of the exemplary dispenser with a first sheet material roll depleted of sheet material.

As the roll 80 is depleted of the sheet material 85, the sensing member 114 pivots toward the first roll support 64. Once the roll 80 is depleted as depicted in FIG. 5, the sensing member 114 positions the transfer roller 152 against the feed rollers 66 and 70. This positioning contacts the sheet material 185 from the second roll 180 with the rollers 66 and 70. Continued operation of the lever 74 tears the sheet material 185 from the prong 160 and through the rollers 66 and 70, where the sheet material 185 may be dispensed from the opening 20.

While the present invention has been described in connection with certain preferred embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

What is claimed is:

1. A spacer member for a sheet material dispenser of the type having a first dispensing roll, at least one reserve roll, and a sensing member which is in contact with the first roll to indicate depletion of the first roll and to effect transfer from the first to the second roll, wherein the spacer member is attached to the sensing member and is further positioned between a first sheet material from the first dispensing roll and a second sheet material from the reserve roll for minimizing contact between the first and second sheet materials and preventing the inadvertent dispensing of the second sheet material.

2. The spacer member for a sheet material dispenser of claim 1 comprising:

a first end;

a second end; and an arcuate body member wherein the first and second ends are formed integrally with the arcuate body member.

3. The spacer member for a sheet material dispenser of claim 2 wherein the first end comprising a curved portion formed integrally with a first leg wherein the first leg extends in a z-direction from the curved portion; and the second end comprising a curved portion formed integrally with a second leg wherein during dispensing the second leg extends in a z-direction and both legs are formed integrally with the arcuate body member wherein the arcuate body member extends in an opposing z-direction in relation to the first and second legs and in a y-direction.

4. The spacer member for a sheet material dispenser of claim 1 wherein the spacer member serves as a wedge to separate the first and second sheet materials should these sheet materials come into contact.

5. A sheet material dispenser, comprising:

a first roll support for holding a first dispensing roll;

a second roll support for holding a reserve roll; and a transfer mechanism further comprising:

a transfer arm adapted to dispense sheet material from the first dispensing roll and then to dispense sheet material from the second dispensing roll;

a sensing member adapted to detect when the first dispensing roll is depleted, and to position the transfer arm from the first to the second dispensing roll; and a spacer member, positioned between the first and second sheet materials for minimizing contact between sheet material from the first and second rolls.

6. A sheet material dispenser, comprising:

a first roll support for holding a first dispensing roll of sheet material;

a second roll support for holding a reserve dispensing roll of sheet material;

a mechanism adapted to sense depletion of sheet material from the first roll and transfer dispensing of sheet material from the first roll to the reserve roll, the mechanism further comprising a spacer disposed between the sheet material from the first dispensing roll and the sheet material from the reserve dispensing roll, the spacer adapted to separate and minimize contact between sheet material from the first dispensing roll and sheet material from the reserve dispensing roll.

7. A sheet material dispenser, comprising:

a first roll support for holding a first sheet material roll;

a second roll support for holding a second sheet material roll wherein the rolls are substantially aligned;

a sensing member for determining the amount of sheet material left on a first sheet material roll and for positioning sheet material from a second sheet material roll away from sheet material from the first sheet material roll during dispensing of the first sheet material roll; and a spacer member coupled to the sensing member for minimizing contact between sheet material from the first and second rolls, wherein the spacer member is positioned between sheet material from the first roll and sheet material from the second roll.

8. The sheet material dispenser of claim 7, further comprising:

a housing wherein the first and second roll supports, and the sensing member are coupled to the housing;

first and second feed rollers coupled to the housing wherein sheet material from the first sheet material roll passes through the first and second feed rollers;

a sensing roller coupled to the sensing member wherein the sensing roller contacts sheet material from a first sheet material roll and sheet material from a second sheet material roll; and a dispensing lever in mechanical communication with the feed rollers for dispensing sheet material from the sheet material rolls whereby upon depletion of the first sheet material roll the sensing member positions sheet material from the second sheet material roll into the feed rollers for dispensing.

9. A method for dispensing sheet material comprising the steps of:

providing a first roll having sheet material;

providing a second roll having sheet material; and providing a means for separating sheet material disposed between the sheet from the first roll and the sheet material from the second roll to separate roll to separate and minimize contact between sheet material between the respective sheet materials from the first and second rolls and preventing the premature feed of sheet material from the second roll.

* * * * *